United States Patent [19]

Fodge

[11] Patent Number: 5,067,642

[45] Date of Patent: Nov. 26, 1991

[54] SHOULDER HOLSTER WITH CONCEALED SUPPORTING CHEST STRAP

[76] Inventor: Gary L. Fodge, General Delivery, Globe, Ariz. 85501

[21] Appl. No.: 623,516

[22] Filed: Dec. 7, 1990

[51] Int. Cl.[5] ..... F41G 33/02

[52] U.S. Cl. ..... 224/192; 24/607; 224/194; 224/206; 224/911

[58] Field of Search ..... 224/192, 194, 198, 206, 224/911, 912; 24/607, 453, 459; 411/348

[56] References Cited

U.S. PATENT DOCUMENTS

| | | | |
|---|---|---|---|
| D. 214,560 | 7/1969 | Kassel | 224/911 |
| 834,419 | 10/1906 | Stewart | 224/206 |
| 1,601,963 | 10/1926 | Arth | 224/193 |
| 1,917,844 | 7/1933 | Keith | 224/193 |
| 2,443,397 | 6/1948 | Myres | 224/193 |
| 3,797,715 | 3/1974 | Scialdone | 224/206 |
| 3,865,290 | 2/1975 | Sperling | 224/194 |
| 4,617,771 | 10/1986 | Tomaszewski | 24/459 |
| 4,727,699 | 3/1988 | Sargent | 224/459 |
| 4,785,983 | 11/1988 | DeSantis | 224/206 |
| 4,903,874 | 2/1990 | Shoemaker | 224/206 |

*Primary Examiner*—Renee S. Luebke
*Attorney, Agent, or Firm*—J. Michael McClanahan

[57] ABSTRACT

A shoulder holster is disclosed to be worn outside an officer's shirt operably attaching to a chest strap worn under the Officer's shirt without making a hole in the shirt. An annularly shaped shirt lock hub having a circular groove formed in the interior opening attaches to the chest strap, all under the shirt. Outside the shirt, an annularly shaped shirt lock of four movable segments is held together by a circumscribing spring. Around the periphery of each segment is an outwardly protruding circular tongue. A cone-shaped retractable cylindrical expander resides just partially interiorly the central opening of the shirt lock. Immediately juxtaposed the shirt lock is an annular seal plate followed by a leather strap attached to the shoulder holster, the strap in turned followed by a backing plate. A shirt lock expansion screw resides in a central opening of the back plate which passes through the central openings of the leather strap, seal plate, and annular shirt lock to screw into a threaded opening in the expander. The shirt lock is inserted into the shirt lock hub central opening and pushes the shirt through this opening. The circular tongues mate with the circular groove when expander is retracted into the shirt lock to expand it, thus securing the shoulder holster onto the shirt lock hub through the shirt.

18 Claims, 2 Drawing Sheets

SHOULDER HOLSTER WITH CONCEALED SUPPORTING CHEST STRAP

BACKGROUND OF THE INVENTION

1. Field of the Invention

The field of the invention is shoulder holsters worn outside the party's shirt for carrying handguns wherein the means supporting the holster is concealed under the shirt of the party wearing the shoulder holster and the shirt is not punctured.

2. Description of the Related Art

All of the shoulder holsters known to the Applicant which are worn outside the operator's shirt employ chest straps or shoulder-type straps (or a combination thereof) which also reside outside the shirt. For example, the devices shown in various U.S. Pat. Nos., such as No. 1,601,963 to Arth, Design Patent No. 214,560 to Kassel, No. 4,903,874 to Shoemaker, and No. 1,917,844 to Keith show various varities of shoulder holsters wherein the mechanism supporting the holster resides exteriorly to the operator's shirt. Generally the supporting mechanism consists of a series of straps, one adapted to reside around the party's chest and another strap over one of the operator's shoulders. The holster is then concealed by the wearing of a jacket over the operator's shirt where, by positioning the holster underneath the person's arm or proximate that position, the holster is hidden except when the person opens their jacket wide or removes their jacket.

Of course, the method of securing a shoulder holster by means of concealed chest straps and shoulder straps is known where an opening or a plurality of openings are formed in the shirt to allow passage of the fastening means between the strap and the holster.

Other means by which shoulder holsters may be secured are shown in U.S. Pat. No. 2,443,397 to Myres wherein the holster is operably secured to both a shoulder strap and to a flexible plate which is placed under the belt of the operator. Stewart, in U.S. Pat. No. 834,419, discloses a shoulder holster which is hung from a chest strap, the strap situated outside the operator's shirt but, when worn with a sleeveless vest, is concealed by the vest. The strap by which the holster is hung is secured to the chest strap in the area of the sleeve openings of the vest.

Now Scialdone in U.S. Pat. No. 3,797,715 provides a novel shoulder holster and harness in which the harness is worn under the shirt, however, the holster is also worn under the shirt. By such means, both the holster and the harness is concealed. In order to withdraw a handgun from the holster, the operator must unbutton at least one button on his shirt and then reach inside the shirt to grasp the gun.

Aside from the obvious method of penetrating the wearer's shirt with an opening through the shirt which allows communication between the holster and the chest strap, the inventor is unaware of any means by which a shoulder holster is supported outside the operator's shirt by a chest strap concealed inside the operator's shirt.

It is readily apparent that for convenience and safety to the operator, the shoulder holster should be worn outside one's shirt. However, for appearances and possibly for the operator's safety, the presence of a visible chest strap and/or shoulder strap supporting the holster is not always called for.

It is therefore obvious that there is need for apparatus which will permit a shoulder holster to be worn outside one's shirt, but with the supporting mechanism worn inside one's shirt. It is to this need that the subject invention is directed.

SUMMARY OF THE INVENTION

The embodiment of the invention described consists of a shoulder holster worn exteriorly to an operator's shirt but where the supporting mechanism, a chest strap, is worn interiorly of the operator's shirt and that the holster is supported without a penetration through the shirt itself, i.e., no holes are made in the shirt to accommodate the securing mechanism between the chest strap and the holster.

In construction, the subject invention comprises firstly a chest strap adapted to encompass the chest of the wearer or operator. For comfort sake, a portion of the strap may be of elastic material with the strap itself being preferably cloth. To maintain the chest strap at the right height, a shoulder strap adapted to pass over one shoulder attaches to the chest strap at positions on the front and the back of the operator. To this chest strap is attached an annularly-shaped disk like shirt lock hub wherein, in the cylindrical wall of the central opening, circular groove is formed. It is expected that the operator's shirt will pass over the chest strap and attached shirt lock hub and, as shown later, a portion of the shirt normally covering the hub will reside interiorly to the central opening of the shirt lock hub.

The other major portion of the invention comprises the shirt lock means adapted to engage this circular groove formed in the central opening of the shirt lock hub. Firstly, a shirt lock consisting of a four segmented annularly shaped disk has a corresponding protruding circular tongue on the outside peripheral surface of each of the segments of the disk. This tongue comprises the means which engages the circular groove and is so sized such that the shirt itself passes between the circular groove and the protruding circular tongue when the tongue engages the groove. It is obvious that the shirt lock circular disk must be sized small enough to pass into the central opening of the shirt lock hub together with the operator's shirt in the central opening. The shirt lock annularly shaped disk then expands while it is in the central opening of the shirt lock hub and more particularly, the outwardly protruding circularly-shaped tongue of the shirt lock disk expands into the circular groove of the shirt lock hub.

To accomplish this, as mentioned before, the annularly shaped shirt lock disk is segmented into four 90 degree portions, much like a clover, with a central opening through the shirt lock disk to receive the means by which the four segmented pieces are compelled to expand outwardly and thus increase the diameter of the disk.

Expansion of the shirt lock annularly shaped disk is accomplished by means of a cone-shaped cylindrical expander which is drawn into the central opening of the shirt lock by means of an expander screw, the expander having a centrally situated axially aligned threaded hole to receive the expander screw. To assure that the four segments of the shirt lock annularly shaped disk stay in the shape of a circle throughout expansion and contraction, a radially directed slot is formed in each of the four segments, this slot adapted to receive a shirt lock screw having a flat head. Thus, each of the segments are permitted to move in the direction of the slot, namely outward from the center of the shirt lock disk. To urge the four segments into the smallest diameter possible at all times, a compression spring is situated upon the outside circular peripheral surface of the annular shirt lock disk proximate the protruding circular tongue, the spring acting much like a rubber band to keep the shirt lock disk in its smallest configuration except when the segments are pushed outwardly by the incoming cone-shaped expander.

Immediately next to the shirt lock disk is an annularly shaped seal plate which function is to receive the bottom portion of the expander, as well as an expander spring which is always pushing against the bottom of the expander to force it out of the central opening of the shirt lock annular disk when it is not being pulled in by an expander screw. The shirt lock screws which penetrates each of the four segments of the shirt lock pass through properly located holes in the seal plate without attachment thereto.

Next, a leather strap which is ultimately connected or sewed to the shoulder holster has one side juxtaposed the seal plate, the leather strap having at its other side a back plate which brings all elements of the invention together. The other end of the compression spring rests against this leather strap. Holsters commonly have leather straps sewed to them, usually for the purpose of securing the holster to a belt. The back plate has a bevelled opening centrally located which receives the conical-shaped head of the expander screw. In addition, the four shirt lock screws are threaded into properly located threaded holes in the back plate in order that they may be fixedly secured and thus be able to regulate the direction of movement of each of the four segments of the shirt lock annularly shaped disk.

All elements are placed together in the order indicated and held in a secure arrangement. The shirt lock expander screw is adapted to receive an allen wrench in its conical-shaped head for operation of the device. Appropriately located holes are placed in the sides of the holster to allow passage of the shank of the allen wrench into the expander screwhead.

To operate the device once the chest strap and shoulder strap has been secured upon the operator's chest with the shirt lock hub in the desired position, the operator then puts on his shirt. Next, the annularly shaped shirt lock disk is configured to its minimum diameter situation, i.e., the cone-shaped cylindrical expander is not yet pulled into the annular shirt lock disk central opening sufficient to begin outward movement of the four segments. The annular shirt lock disk is pushed into the shirt lock hub central opening, pushing the operator's shirt before it. Once it has been placed into the opening, the operator inserts the allen wrench into the socket in the head of the shirt lock expander screw and begins turning the expander screw. In doing so, the cone-shaped cylindrical expander is pulled into the central opening of the annularly shaped shirt lock disk, causing each of the four segments to move outwardly. The operator moves the shirt lock circular disk about within the central opening of the shirt lock hub until he feels the circular tongue on the peripheral side of the annular shirt lock disk catching in the circular groove formed in the shirt lock hub central opening. It may be necessary for the operator to continue to slowly turn the allen wrench to continue the expansion of the annular shirt lock disk while searching for the circular groove.

When the circular groove is found, the operator completes turning the allen wrench until the circular tongue on the annular shirt lock disk has bottomed with the shirt in between in the circular groove of the shirt lock hub. When that happens, the shoulder holster is secured to the chest strap. It is obvious that the rotational position of the shoulder holster may be varied merely by rotating the shoulder holster to the desired position when circular tongue has engaged the circular groove, but before final tightening.

Since the annular shirt lock disk is generally centrally located on the shoulder holster, the handgun must be absent from the holster at the time that the allen wrench is inserted through the holes in the holster to reach the shirt lock expander screw.

To remove the holster, the above procedure is just reversed, the handgun first being removed and then the allen wrench inserted into the expander screw. By reversing the direction of turning the allen wrench, the expander is forced out of the annular shirt lock disk, allowing it to contract to form a smaller and smaller diameter (helped by the shirt lock spring). To assure that the expander does move out of the central opening of the annular shirt lock disk, the expander spring previously described is continually pushing the expander outward. When the annular shirt lock disk has been reduced to a diameter sufficient that its circular tongue no longer engages the circular groove of the shirt lock hub and in fact when the tongue is smaller than the central opening of the shirt lock hub, the shoulder holster together with its fastening mechanism, i.e., annular shirt lock disk and other attachments, is removed.

The shirt then goes back to a position bridging across the shirt lock hub opening, no longer being pushed into the opening. The operator may then remove his shirt and then the shoulder strap and then chest strap thereafter.

Accordingly, it is an object of the subject invention to provide a shoulder holster to be worn outside an operator's shirt but utilizing a supporting chest strap worn inside the operator's shirt.

It is another object of the subject invention to provide a concealed chest strap for an exterior held shoulder holster where a securing mechanism attached to the shoulder holster operably attaches to the chest strap through the shirt.

It is still a further object of the subject invention to provide a securing mechanism for an over the shirt shoulder holster which operates by engaging a hub attached to a concealed chest strap.

It is still another further object of the subject invention to provide an exterior shoulder holster with concealed chest strap wherein an annular hub attached to the chest strap receives in its central opening an annular shirt lock device which expands in that central opening to be secured there, such device then operably attached to the shoulder holster.

Other objects of the invention will in part be obvious and will in part appear hereinafter. The invention accordingly comprises the apparatus possessing the construction, combination of elements, and arrangement of parts which are exemplified in the following detailed disclosure, and the scope of the invention which will be indicated in the claims.

BRIEF DESCRIPTION OF THE DRAWINGS

For further understanding of the features and objects of the subject invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
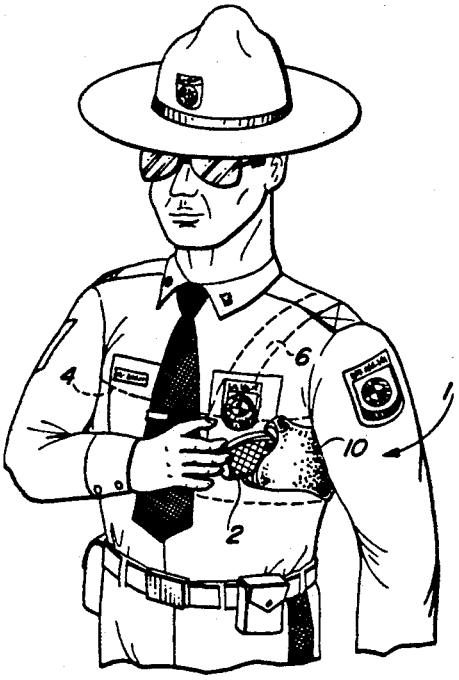
FIG. 1 is a front view of an officer wearing the subject inventive shoulder holster with concealed chest strap.

The subject exteriorly worn shoulder holster which operably attaches to a harness worn under the party's shirt, but yet which does not require a penetration of the shirt, is shown in a front view of an Officer in FIG. 1. Officer 1 is shown with the subject shoulder holster 10 in a right-hand position with the butt of the holstered handgun 2 protruding from the holster. Also shown in dotted fashion is the chest strap 4 which secures a shirt lock hub (not seen) to which holster 10 is operably attached. Passing over the Officer's left shoulder is shoulder strap 6, shoulder strap 6 operably connected to chest strap 4 in the front and in the rear.

As may be seen later from the description of the apparatus comprising the invention, the position of the holster is variable, i.e., the holster may be rotated upon the shirt lock hub attached to the chest strap such that the handgun may take a position with the barrel pointing horizontal, as shown in FIG. 1, or vertical, or any position in between as each particular party wearing the invention may desire. In addition, chest strap 2, which may be a leather or cloth strap, has incorporated into it an elastic portion which is behind the Officer's back. Thus, chest strap 6 may be comfortably worn and may be situated so that the shirt lock hub (later described) attached to the strap may be placed on either side of the Officer's chest, and at any height, such as to place the handgun in a left-hand or right-hand draw configuration.

Figure 2:
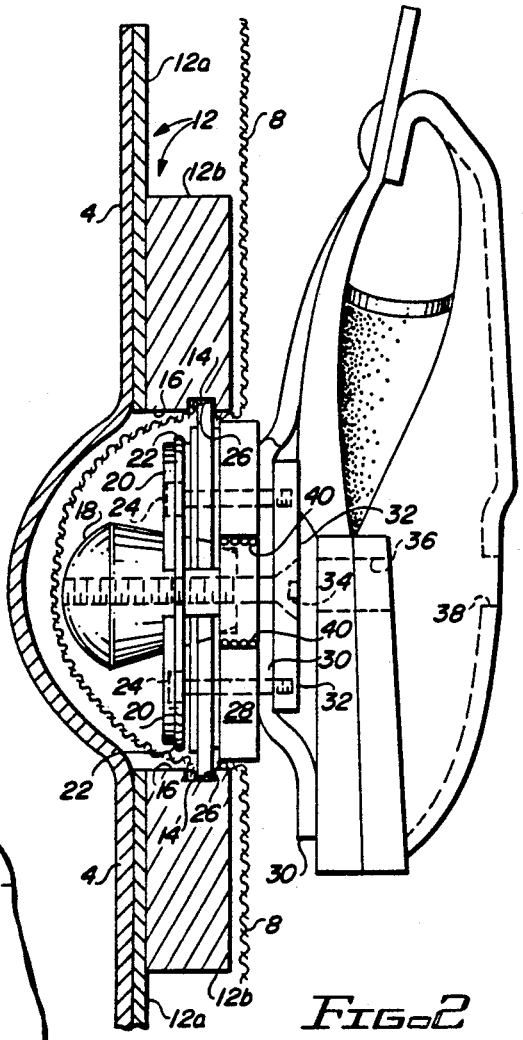
FIG. 2 is a side view in partial cross section showing the invention in place on the officer's chest.
Figure 4:
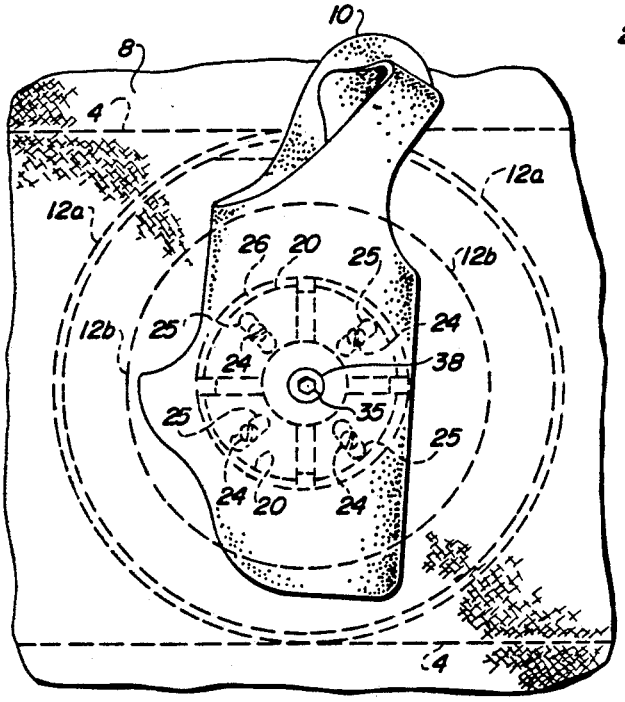
FIG. 4 is a front view of the invention in place upon the chest of the officer.

Referring now to FIG. 2, a side view of the subject invention is detailed wherein for clarity a portion of the invention is shown in cross section, namely the chest strap, the shirt lock hub, and the Officer's shirt. More specifically, commencing at the left part of FIG. 2 and moving right, first shown is chest strap 4. In the drawing of FIG. 2, the Officer's skin would be touching the left side of chest strap 4. Jumping to the right a bit, the Officer's shirt 8 is shown with the shirt lock hub 12 interposed chest strap 4 and the shirt. Shirt lock hub 12 comprises, as also is seen in FIG. 4, an annular disk which is attached to chest strap 4 by sewing or an appropriate adhesive. Normally, shirt lock hub 12, which has two major pieces, comprises a flexible disk 12*a* which may be leather or heavy canvas material, and an annular ring 12*b* with a groove 14 formed in the wall of the center opening of annular ring 12*b*. The groove is so situated that the circle made by its bottom is coaxial or concentric with center opening 16 of annular ring 12*b*.

Annular ring 12*b* is made from a durable type material and may be metal such as aluminum or, it may be made from multiple layers of leather which have been hardened by the use of various chemicals and adhesives gluing the multiple layers together.

It is noted that in the embodiment of the invention shown in FIG. 2, that the only part of the invention which resides under the Officer's shirt is chest strap 4 and shirt lock hub 12. The portion of the invention which secures the holster 10 outside the officer's shirt is also shown in FIG. 2 and is next described.

Figure 3:
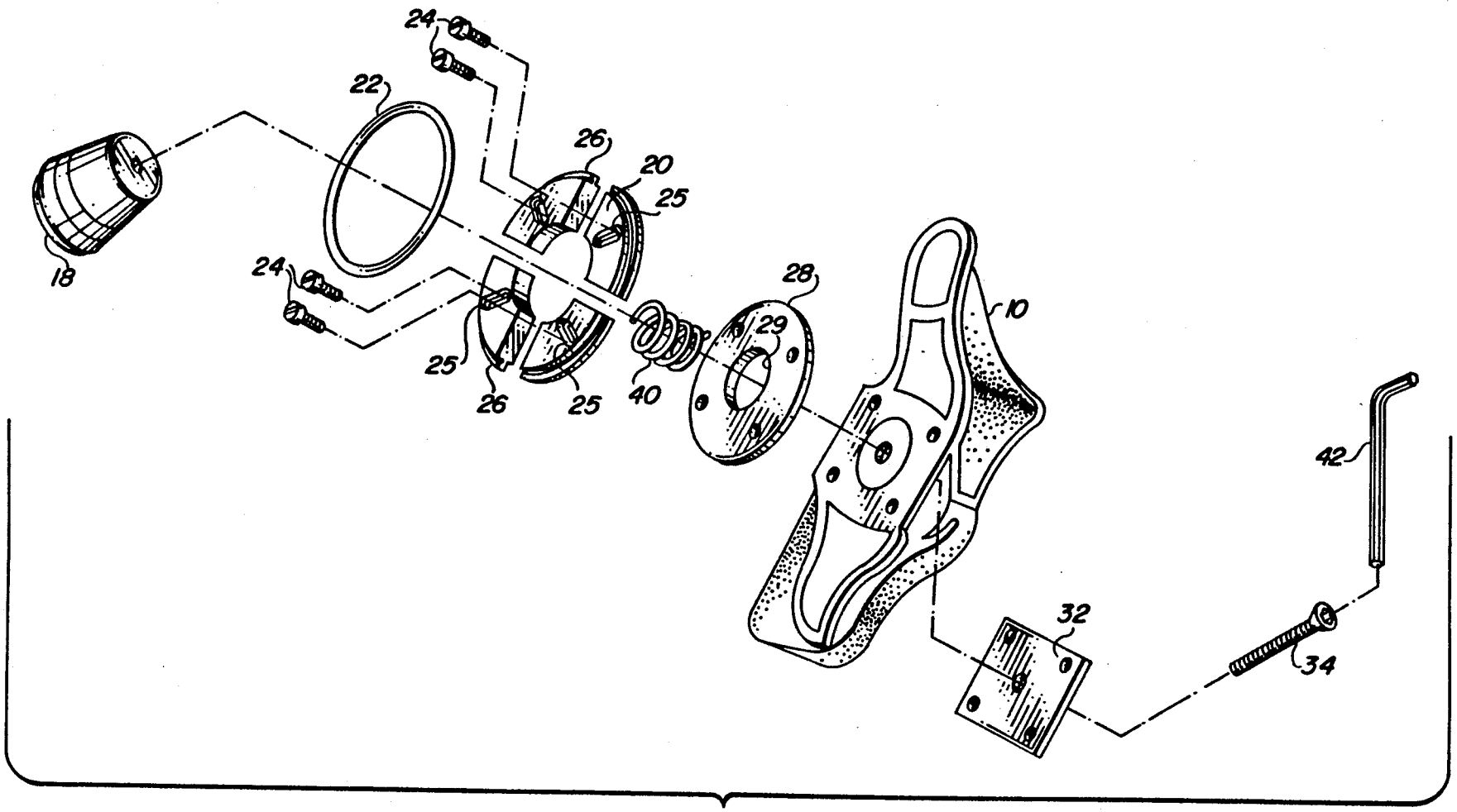
FIG. 3 is an exploded perspective view of the annular shirt lock disk showing all its elements in a disassembled configuration.

More specifically, shown on the left is expander 18 comprising a cone shaped cylinder having a centrally and coaxially located threaded hole. Next is annularly shaped shirt lock disk 20 which, as will be seen in FIGS. 3 and 4, is a cloverleaf type construction with four 90 degree segments, each segment adapted to move in and out in a radial direction by movement of expander 18 in and out of its central opening. Encompassing the peripheral sides of annular shirt lock disk 20 is a spring which forces each of the segments of annularly shaped shirt lock 20 inwardly to maintain the smallest overall diameter possible and so that they are always tight against expander 18. This spring is shown as shirt lock spring 22 in FIG. 2 circumscribing the outer circular peripheral side of shirt lock 20. In the preferred embodiment, a groove was formed in the annularly shaped shirt lock outer peripheral wall to receive and secure this spring, the groove having a semi-circular cross-section.

Ascertaining that each of the 4 segments making up annular shirt lock 20 stay in place are 4 shirt lock screws 24 which are shown in dotted fashion just below the top flat circular surface of annular shirt lock 20. These screws, which are fastened into the back plate later described, have their shank passing through an elongated radially directed slot formed in each of the segments of annular shirt lock 20. The head of these screws 24 ride in an elongated radially directed recess overlying the elongated radially directed slots receiving the shanks of the screws. Thus, each of the four segments of annular shirt lock 20 may move inward and outward about each of the screw shanks in accordance with the force applied by expander 18 to enlarge the diameter of annular shirt lock 20 or the tension applied by spring 22 to reduce the diameter of annular shirt lock 20.

Annular shirt lock 20 also contains an circularly shaped tongue 26 (square in cross-section) which is adapted to reside interiorly to the circular groove 14 (which is also square in cross-section) formed in the central opening of annular ring 12*b* of shirt lock hub 12. This is the mechanism which secures annular shirt lock 20 within shirt lock hub 12. Naturally, holster 10 is operably attached to annular shirt lock 20. It is noted, as seen in FIG. 2, that the Officer's shirt 8 passes over circular tongue 26 and therefore the shirt will also reside interiorly to circular groove 14 formed in shirt lock hub 12. There is sufficient clearance between the thickness of each circular tongue 26 formed in each segment of annular shirt lock 20 and the width of circular groove 14 formed in shirt lock hub 12 to assure that the Officer's shirt will not be torn such as to cause a rip or a hole.

As expander 18 is brought into the central opening of annular shirt lock 20, shirt 8 will be compressed against the bottom of circular groove 14 by circular tongue 26.

Immediately next to annular shirt lock 20 is seal plate 28, seal plate 28 being an annular disk having an outside diameter somewhat smaller than the inside diameter of the circular opening through shirt lock hub 12. Seal plate 28 also contains a central opening which also allows the entrance of the base or bottom portion of expander 18 when expander 18 is retracted into annular shirt lock 20. Occupying the central opening of seal plate 28 is expander spring 40 which is compressed. Expander spring 40 is shown in cross section since otherwise would make FIG. 2 confusing. It presses against expander 18 at one end and leather strap 30 (next discussed) at its other end.

Next, leather strap 30, which is attached to holster 10 at points above and below its connection with seal plate 28, abuts seal plate 28 and is the means by which the holding mechanism now being described fastens to the holster. Leather strap 30 is sewed or adhesively attached to holster 10.

Lastly, back plate 32 is secured behind leather strap 30 and becomes the means securing all of the holding mechanism together. Into the 4 threaded holes formed in back plate 32 are screwed the four shirt lock screws 24 which direct the radial movement of each of the four segments of annular shirt lock 22.

Shirt lock expansion screw 34, whose head resides in a countersunk central opening in back plate 32, has its shank extending through the central opening of seal plate 28, through expander spring 40, and through the central opening of annular shirt lock 20 where its threaded shaft engages the female threads interiorly the central opening of expander 18. In the preferred embodiment, shirt lock expansion screw 34 is adapted to receive an allen wrench in its head which becomes the means by which the screw is rotated. When shirt lock expansion screw 34 is rotated, it either draws to itself expander 18 (which pulls expander 18 into the central opening of annular shirt lock 20 or allows expander 18 to be pushed out of annular shirt lock 20. Thus, by the movement of expander 18 in the central opening of shirt lock 20, each of the four segments of the shirt lock are caused to move radially and thus expand or contract the overall diameter of the circular tongue 26 at the peripheral side of annular shirt lock 20.

Shown in holster 10 are openings 36 and 38 which allows penetration of the allen wrench for engaging shirt lock expansion screw 34. In most cases, the handgun carried in holster 10 will have to be removed in order to insert the allen wrench through the two openings.

Referring now to FIG. 3, a perspective view is shown of the invention (less shirt lock hub 12) in a disassembled exploded view. More particularly, and commencing from the left, expander 18 is shown detailing its conical cylindrical shape with the co-axial centrally threaded opening therethrough. Next is shirt lock spring 22 which, as detailed in FIG. 2, is placed on the peripheral rim or side of annular shirt lock 20 to cause each of the four segments to move to maintain the smallest effective diameter of annular shirt lock 20. Shown in FIG. 3 is annular shirt lock 20 comprising its four segments, each segment consisting of a 90 degree portion of a completed circle, annular shirt lock 20 characterized by also having a central opening adapted to receive the conical sides of expander 18. Also seen are the outwardly protruding circular tongue 26 on each segment (which is square in cross-section), said tongues adapted to reside in circular groove 14 of shirt lock hub 12 (which is also square in cross-section). Four shirt lock screws 24 reside in radially directed elongated slot 25 formed in each of the four segments of annular shirt lock 20. An elongated recess above slot 25 receives the flat head of shirt lock screws 24.

Immediately below annular shirt lock 20 is expander spring 40 which resides within the central opening 29 of seal plate 28 and has one end pressed against the conical sides of expander 18. This assures that the head of shirt lock expansion screw 34 will not float in back plate 32 in that spring 40 will always be urging expander 18 outward so as to place pressure on screw 34. Next, seal plate 28 is shown with its central opening 29 which receives expander screw 40 and its four holes which receive the shanks of shirt lock screws 24. Note that these four screw holes through seal plate 28 are not threaded, but are large enough to pass without interruption the threads of the shirt lock screws 24. Next, leather strap 30, which is sewn or adhesively attached to holster 10, is shown with a central opening and the four appropriately located holes to also pass the shanks of shirt lock screws 24. As shown in FIG. 3, a shallow circular recess is cut into leather strap 30 concentrically surrounding the central opening to seat the bottom end of expander spring 40.

Next, back plate 32 is shown, here in the preferred embodiment being square, with its centrally located opening receiving the shank of shirt lock expansion screw 34 and also having the four threaded openings into which shirt lock screws 24 are threaded. Lastly, shirt lock expansion screw 34 is shown with its shank adapted to pass through the central opening of back plate 32, of leather strap 30, of seal plate 28, and of annular shirt lock 20 to engage the threaded central opening of expander 18. Shown in dotted fashion upon the end of shirt lock expansion screw 34 is the flaring out of the shank which may be done after the elements shown in FIG. 3 are assembled. If this is done, the central opening in expander 18 will need be also bevelled near the top end to receive the flared out end. Not shown in back plate 32 is the bevelled sides of the central opening on the back side which receives the conical head of screw 34. Shown for insertion into the hexagonal socket opening in the head of screw 34 is allen wrench 42 by which means expander 18 is pulled into the central opening of annular shirt lock 20 to expand each segment's circular tongue 26 into the circular groove 14 of shirt lock hub 12.

Referring now to FIG. 4, a front view of the subject invention in place upon the Officer's chest is detailed. Firstly, holster 10 is shown with exterior opening 38 near its center. Interiorly to opening 38 is seen the 6 sided or hexagon shaped blind socket opening 35 which receives the allen wrench. Then, the next dotted line outwardly represents central opening 29 of seal plate 28 which is aligned with the central opening of annular shirt lock 20. Shown also in dotted fashion are the four segments of annular shirt lock 20 with their elongated slots 25 which receives interiorly thereto shirt lock screws 24. The next outside dotted circle is the exterior circular surface of annular shirt lock 20 and then the outer dotted circle of the outer surface of circular tongue 26 attached to annular shirt lock 20. Next is the outer peripheral line of annular ring **12*b* which in turn is attached to disk 12*a*. Disk 12*a* then is attached in turn to chest strap 4 shown as horizontal dotted lines. Between lines 12*b* and 12*a* is the stitch line attaching shirt lock hub 12 to chest strap 4. Not to be forgotten is the Officer's shirt 8** which is shown by the solid jagged line surrounding the invention.

It is noted that while square shaped circular groove 14 and circular tongue 26 are utilized in the preferred embodiment, yet the invention would work as well utilizing a "V" shaped tongue and groove, or a semi-circular shaped tongue and groove.

In the preferred embodiment, annular shirt lock 20, seal plate 28, and back plate 32 were constructed of a metal such as steel.

While a preferred embodiment of the invention has been shown and described, it will be appreciated that other such embodiments of the invention are possible and that there is no intent to limit the invention by such disclosure. Rather, the disclosure is intended to cover all modifications and alternate embodiments falling within the spirit and the scope of the invention as defined in the appended claims.

I claim:

1. A shoulder holster to be worn outside a person's shirt with no visible supporting chest strap nor with a chest strap piercing the shirt, the shoulder holster comprising:

a holster for receiving a handgun;

a chest strap worn under the person's shirt; and means operably securing said holster to said chest strap, said means defining a shirt lock hub attached to said chest strap under the person's shirt, said shirt lock hub having an interior opening therethrough, said interior opening having a diameter thereof, and an annularly shaped shirt lock attached to said holster, said shirt lock having a diameter thereof less than said shirt lock hub interior opening diameter, said shirt lock hub interior opening adapted to receive therein firstly the person's shirt and secondly said annularly shaped shirt lock, said shirt lock operably engaging said shirt lock hub interior opening to secure said holster to said chest strap whereby said said chest strap is worn inside the person's shirt and said holster is worn outside the person's shirt.

2. The shoulder holster as defined in claim 1 wherein said shirt lock includes as a portion thereof at least one moveable segment, said shirt lock engaging said shirt lock hub interior opening as said shirt lock is inserted into said interior opening to secure said holster to said chest strap.

3. The shoulder holster as defined in claim 2 wherein said shirt lock includes means to move said moveable segment.

4. The shoulder holster as defined in claim 3 wherein said shirt lock includes means to retract said moveable segment after said moveable segment has been moved, said means including a circumscribing spring engaging said shirt lock and moveable segment whereby said moveable segment is retracted.

5. The shoulder holster as defined in claim 4 wherein said means to move said moveable segment includes an expander, said expander engaging said moveable segment to move said segment to increase the diameter of said shirt lock to engage said shirt lock hub interior opening.

6. The shoulder holster as defined in claim 5 further including a shirt lock expansion screw operably attached to said expander, said shirt lock expansion screw operating to move said expander which in turn moves said moveable segment while said shirt lock is in said shirt lock hub interior opening to secure said shirt lock to said shirt lock hub whereby said holster is secured to said chest strap.

7. The shoulder holster as defined in claim 6 wherein said shirt lock includes a plurality of moveable segments, said moveable segments engaging said shirt lock hub interior opening as said shirt lock is inserted into said interior opening to secure said holster to said chest strap.

8. The shoulder holster as defined in claim 7 wherein said plurality of moveable segments comprise four moveable segments, each of said moveable segments comprising a 90 degree portion of a circle, said four moveable segments comprising together a completed circle, said completed circle having a central opening therethrough comprised quarterly of each of said four moveable segments, said expander situated in said central opening and engaging each of said four segments.

9. The shoulder holster as defined in claim 8 wherein said expander defines a retractable cylindrical expander having coned shaped sides, said coned shaped sides engaging each of said plurality of said moveable segments whereby said expander, when retracted, moves said moveable segments to increase the diameter of said completed circle formed by said moveable segments to secure said shirt lock to said shirt lock hub.

10. The shoulder holster as defined in claim 9 further including a plurality of shirt lock screws having threaded shanks, one shirt lock screw for each said moveable segments, each of said moveable segments having a slotted opening therethrough, each said slotted opening receiving one each said shirt lock screws shanks whereby said moveable segments movement is confined by said shirt lock screws.

11. The shoulder holster as defined in claim 10 wherein said circumscribing spring retracting said moveable segment includes said circumscribing spring retracting said plurality of moveable segments.

12. The shoulder holster as defined in claim 11 further including a seal plate, said seal plate having four openings therethrough and a central opening therethrough, each of said four openings receiving one each said shanks of said four shirt lock screws in a slideable non-securing manner, said seal plate juxtaposed said four moveable segments.

13. The shoulder holster as defined in claim 12 further including a strap operably attached to said shoulder holster, said strap having four openings therethrough to receive in a sliding manner each said shanks of each said shirt lock screws, said holster strap juxtaposed said seal plate.

14. The shoulder holster as defined in claim 13 wherein said shirt lock further includes a compression spring, said compression spring residing interiorly to said seal plate central opening and said four moveable segments central opening, said compression spring engaged by said strap and said expander, said expander receiving constant pressure from said compression spring to urge said expander out of said plurality of moveable segments central opening and to work against said shirt lock expansion screw.

15. The shoulder holster as defined in claim 14 further including a backing plate, said backing plate having four threaded openings formed therein, each said four threaded openings receiving each said shanks of each said four shirt lock screws to secure said screws, said backing plate juxtaposed said strap whereby said moveable segments, seal plate, compression spring, and strap are interposed said expander and said backing plate.

16. The shoulder holster as defined in claim 15 wherein said cone-shaped retractable expander includes a centrally located threaded opening, said threaded opening receiving said shirt lock expansion screw, said shirt lock expansion screw passing through said plurality of moveable segments central opening, said seal plate central opening, said compression spring, said strap, and said backing plate whereby said moveable segments, seal plate, compression spring, strap, and backing plate are held together by said shirt lock expansion screw and said cone-shaped retractable expander.

17. The shoulder holster as defined in claim 16 wherein said shirt lock expansion screw has a head, said head residing against said backing plate and adapted to be engaged by an allen wrench, and said holster includes a plurality of openings therethrough, said openings aligned with said expansion screw head, said expansion screw head engaged by said allen wrench through said aligned openings in said holster to rotate said shirt lock expansion screw and retract said cone-shaped expander into said moveable segments central opening to expand said completed circle formed by said moveable segments to secure said moveable segments to said shirt lock hub interior opening and thereby secure said holster to said chest strap.

18. The shoulder holster as defined in claim 17 wherein each said moveable segments include outwardly protruding tongues, and said shirt lock hub interior opening includes an annular groove therein, said moveable segments outwardly protruding tongues engaging said shirt lock hub interior opening annular groove with the person's shirt therebetween to secure said shirt lock to said shirt lock hub and thereby secure said holster to said chest strap.

* * * * *